US005602531A

United States Patent [19]

Rude et al.

[11] Patent Number: 5,602,531

[45] Date of Patent: Feb. 11, 1997

[54] ELECTRONIC ARTICLE SURVEILLANCE SYSTEM WITH ADAPTIVE FILTERING AND DIGITAL DETECTION

[75] Inventors: Michael J. Rude, St. Paul; Samuel H. Tao; John E. Nelson, both of Woodbury, all of Minn.

[73] Assignee: Minnesota Mining and Manufacturing Company, St. Paul, Minn.

[21] Appl. No.: 646,005

[22] Filed: May 7, 1996

Related U.S. Application Data

[63] Continuation of Ser. No. 418,817, Apr. 7, 1995, abandoned.

[51] Int. Cl.[6] ..... G08B 13/181

[52] U.S. Cl. ..... 340/572; 340/551; 340/552

[58] Field of Search ..... 340/572, 551, 340/552

[56] References Cited

U.S. PATENT DOCUMENTS

| | | | |
|---|---|---|---|
| 3,863,244 | 1/1975 | Lichtblau | 340/572 |
| 4,135,183 | 1/1979 | Heltemes | 340/572 |
| 4,524,350 | 6/1985 | Eccleston | 340/572 |
| 4,535,323 | 8/1985 | Eccleston | 340/572 |
| 4,667,185 | 5/1987 | Nourse et al. | 340/572 |
| 4,668,942 | 5/1987 | Eccleston et al. | 340/551 |
| 4,743,871 | 5/1987 | Searle | 333/166 |
| 4,859,991 | 8/1989 | Watkins et al. | 340/572 |
| 4,881,061 | 11/1989 | Chambers | 340/568 |
| 4,888,579 | 12/1989 | ReMine et al. | 340/572 |
| 5,103,209 | 4/1992 | Lizzi et al. | 340/572 |
| 5,189,397 | 2/1993 | Watkins et al. | 340/572 |
| 5,208,837 | 5/1993 | Richey | 375/103 |
| 5,264,829 | 11/1993 | Paul et al. | 340/572 |
| 5,276,430 | 1/1994 | Granovsky | 340/572 |
| 5,300,922 | 4/1994 | Stoffer | 340/572 |
| 5,349,339 | 9/1994 | Kind | 340/572 |
| 5,353,011 | 10/1994 | Wheeler et al. | 340/572 |

FOREIGN PATENT DOCUMENTS

| | | | |
|---|---|---|---|
| WO83/01331 | 4/1983 | WIPO | G08B 13/18 |

*Primary Examiner*—Glen Swann

*Attorney, Agent, or Firm*—Gary Griswold; Walter N. Kirn; Kari H. Bartingale

[57] ABSTRACT

An electronic article surveillance (EAS) systems includes an asynchronous noise suppression adaptive filter which removes asynchronous interference from the signal of interest with minimum distortion of the transients emitted when a sensitized tag is interrogated. The system also includes a synchronous noise suppression filter which removes interrogation synchronous noise from the signal of interest. The resulting EAS system increases the likelihood that a sensitized tag will be detected when one is present and reduces the occurrence of false alarms.

20 Claims, 12 Drawing Sheets

ELECTRONIC ARTICLE SURVEILLANCE SYSTEM WITH ADAPTIVE FILTERING AND DIGITAL DETECTION

This is a continuation of application Ser. No. 08/418,817 filed Apr. 7, 1995, now abandoned.

BACKGROUND

Electronic article surveillance (EAS) systems are often used to prevent unauthorized removal of articles from a protected area, such as a library or retail store. An EAS system usually includes an interrogation zone or corridor located near the exit of the protected area and markers or tags attached to the articles to be protected. EAS systems have been based on magnetic, RF, microwave and magneto-strictive technologies. Regardless of the particular technology involved, the EAS systems are designed such that the tag will produce some characteristic response when exposed to an interrogating signal in the corridor. Detection of this characteristic response indicates the presence of a sensitized tag in the corridor. The EAS system then initiates some appropriate security action, such as sounding an audible alarm, locking an exit gate, etc. To allow authorized removal of articles from the protected area, tags that are either permanently or reversibly deactivatable (i.e., dual status tags) are often used.

In the ideal case, the EAS system initiates an alarm sequence only when a sensitized tag is present in the corridor. However, EAS systems are sensitive to electromagnetic interference in their operating environment which can interfere with detection of a sensitized tag or can cause false alarms. The degree of sensitivity to interference depends on a variety of factors, such as the type of EAS system, the operating bandwidth of the system, the bandwidth and statistical characteristics of the interference, and the system receiver design. Many EAS systems operate at a frequency of approximately 10 to 40 KHz. This frequency band may contain significant asynchronous interference in a library environment, principally from CRTs and TVs. Depending on their distance from the EAS system, these sources of interference can impair or disable detection ability.

Synchronous interference can be synchronous with either the power line signal or with the EAS system itself. Interrogation synchronous interference occurs when the drive field signal generated during an interrogation activates other objects in the environment, such as metal door frames, metal wall studs, metal gates or other metal objects. These objects then emit a signal which is often similar to the characteristic response of a magnetic tag. Power line synchronous interference is noise that tends to occur during the same point relative to the phase of the power line signal. Both interrogation and power line synchronous interference can reduce the ability of an EAS system to detect a sensitized tag or can cause false alarms.

When noise is spectrally overlapping, as with the types of interference described above, it is very difficult to suppress using conventional linear filtering methods. Because the spectral signature of the magnetic tag is broadband, any in-band filtering of the received signal to remove interference will distort the signal of interest. In a linear filtering scheme, a trade-off exists between filtering the noise and distorting the signal of interest. Thus, a linear filtering scheme alone may not increase the reliability of an EAS system.

SUMMARY

The present electronic article surveillance (EAS) systems includes an adaptive filter which removes synchronous and asynchronous interference from the signal of interest with minimum distortion of the transients emitted when a sensitized tag is interrogated. The resulting EAS system increases the likelihood that a sensitized tag will be detected when one is present and reduces the occurrence of false alarms.

BRIEF DESCRIPTION OF THE DRAWINGS

In the drawings, where like numerals refer to like elements throughout the several views.

DETAILED DESCRIPTION

In the following detailed description, reference is made to the accompanying drawings which form a part hereof, and in which is shown by way of illustration a specific embodiment in which the invention may be practiced. It is to be understood that other embodiments may be utilized and structural changes made without departing from the spirit and scope of the present invention.

Figure 1:
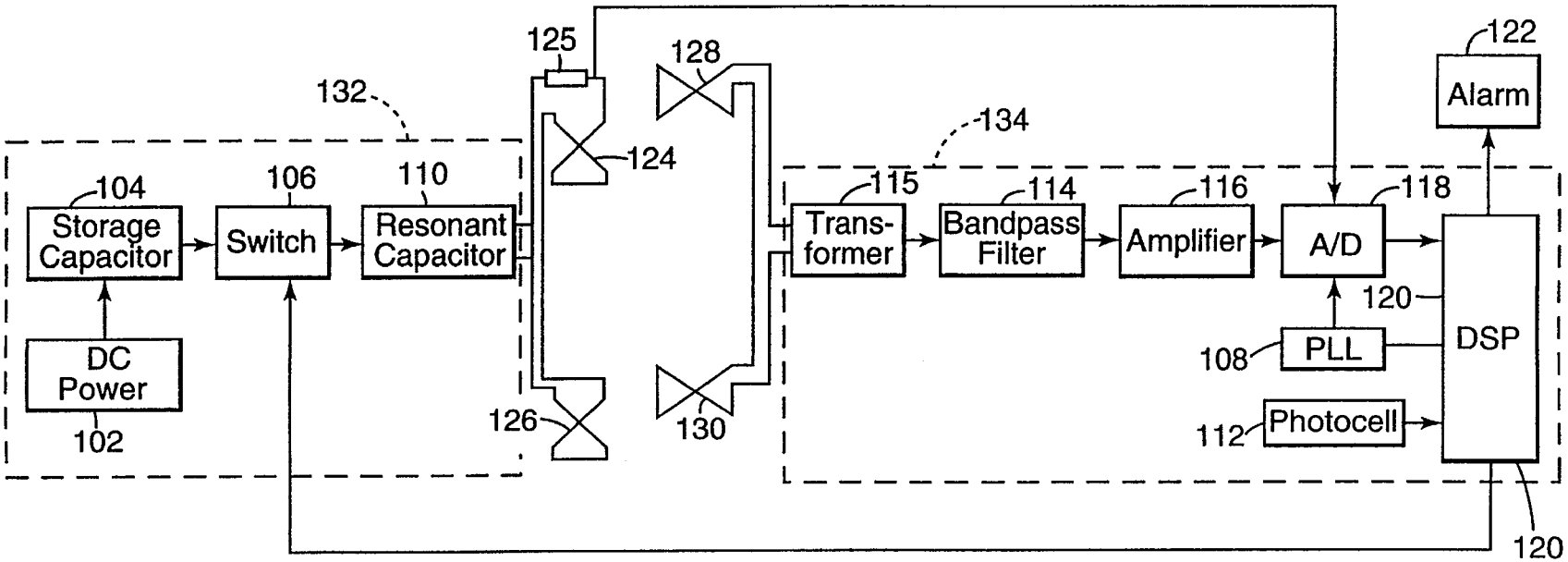
FIG. 1 shows a block diagram of the present EAS system.

A more detailed block diagram for the present EAS system 100 is shown in FIG. 1. The EAS system is preferably of the magnetic type and includes field producing coils 124 and 126, and field sense coils 128 and 130 which are positioned to provide an interrogation zone or corridor in between. In the preferred embodiment, field producing coils 124 and 126 and field sense coils 128 and 130 are of the magnetic "FIG. 8" type described in commonly assigned U.S. Pat. No. 4,135,183. In the event that the EAS system is a nonmagnetic type, such as RF, magneto-strictive, or other type of EAS system, field producing coils and field sense coils would be replaced by the appropriate interrogation signal generators and signal sense detectors for the particular type of system that is implemented. For purposes of illustration, however, the present detailed description will focus on the preferred magnetic system implementation.

The field producing coils 124 and 126 are energized by a field power supply indicated generally by phantom line 132, within which are included a DC power supply 102, a bank of storage capacitors 104, switch 106, and a bank of resonating capacitors 110.

The field producing coils 124 and 126 are connected together with the bank of resonating capacitors 110 to form a resonant circuit. This circuit is energized by discharging the bank of storage capacitors 104 through the resonant circuit. The discharge of the storage capacitors 104 is controlled by switch 106 which is in turn controlled by a timing signal generated by PLL 108 and by digital signal processing (DSP) block 120. A DC power supply 102 is provided to charge the storage capacitors 104 between discharge cycles.

In response to the discharging of the storage capacitors 104 into the resonant circuit, a drive field signal in the form of a damped sinusoidal magnetic field is produced by the coils 124 and 126 and the resonating capacitors 110. The field producing coils 124 and 126 are preferably connected in parallel and have an inductance of approximately 400 μH each. The bank of resonating capacitors 110 and the field producing coils 124 and 126 are preferably selected to provide a damped oscillation which persists approximately 16 milliseconds, has a resonant frequency of about 950+/−50 Hertz, and a magnitude of about 4 Oe in the middle of the corridor.

An interrogation sequence consists of a sequence of drive field signals which are fired while a patron is in the corridor. Each patron is thus interrogated multiple times while passing through the corridor. In the preferred embodiment, an interrogation sequence is initiated when a photocell 112 or other detector detects a patron entering the corridor. The detector interrupts the DSP 120 which then initiates an interrogation sequence. This type of system is commonly referred to as a "pulsed" system. In an alternate preferred embodiment, the system continuously interrogates at periodic intervals, regardless of whether a patron is in the corridor. Such as system is commonly referred to as a "continuous" system. Those of ordinary skill will readily appreciate that the principles described herein with respect to the preferred embodiment are readily applicable to pulsed, continuous, or any other type of interrogation system.

One advantage of the preferred pulsed EAS system is that the average magnetic energy that patrons in or near the corridor are exposed to is minimized. In particular, the present EAS system desirably has an average magnetic energy of less than 1.0 Oe, preferably less than 0.5 Oe, more preferably less than 0.2 Oe, and even more preferably approximately 0.1 Oe. For example, the average magnetic energy for a single interrogation pulse can be determined by $$H_{rms}=\sqrt{\frac{\sum_{i=0}^{N-1} H_i^2}{N}}\ .$$

For a time length N of 0.016 seconds, $H_{rms}$=0.527 Oe for a single interrogation pulse. When no interrogation is occurring, $H_{rms}$=0. If a patron takes approximately 0.5 seconds to pass through the corridor, the EAS system will fire six interrogation pulses. Using the time average function of superposition, the average magnetic energy that a patron is exposed to while passing through the preferred embodiment of the present EAS system is given by $$H_{rms}=\frac{\sum_i H_{i,rms}\cdot t_i}{\sum_i t_i}\ .$$

In the present case, $$H_{rms}=\frac{0.527(0.016)(6)}{0.5}=0.101\text{ Oe.}$$

If a sensitized tag is present in the corridor, the drive field signal causes the sensitized tag to emit its characteristic response (the sensitized tag signal). The signal present in the corridor is sensed by the field sense coils 128 and 130. These coils are preferably connected in series and are coupled to receiver 134, which includes a transformer 115 for signal gain and impedance matching. The output of the transformer 115 passes through an analog bandpass filter 114 to limit the bandwidth of the received signal. Amplifier 116 includes several parallel gain stages 116-1 through 116-i(FIG.2), and each output of a gain stage is sampled by an analog-to-digital (A/D) converter 118 for use by the DSP 120.

A/D 118 also samples the drive field signal via a metering resistor 125 in series with one of the field producing coils. The sampled drive field signal can be used to determine the integrity of the drive field signal, to remove any residual field signal picked up by the field sense coil, and to determine timing necessary for detection, as described below with respect to FIGS. 10 and 11.

DSP 120 processes the sampled signal to suppress synchronous and asynchronous interference. DSP 120 then analyzes the processed signal via a detection and discrimination process to determine whether a sensitized tag is present in the corridor. If a sensitized tag is detected, alarm system 122 initiates an appropriate alarm sequence, such as sounding an audible alarm, flashing an alarm light, locking an exit gate, or other suitable security measures.

Figure 2:
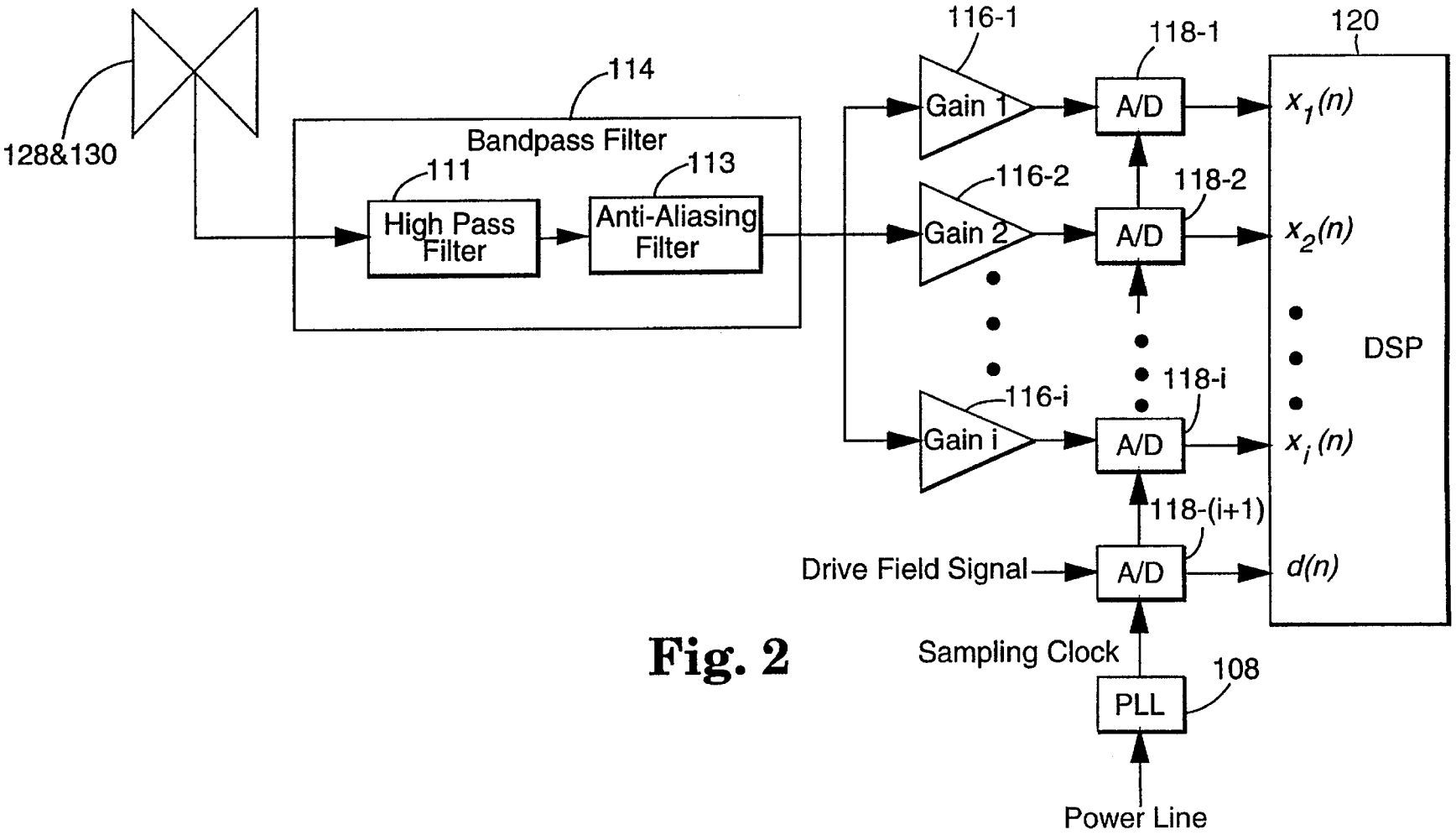
FIG. 2 shows a more detailed block diagram of the receiver of the present EAS system.

FIG. 2 shows a more detailed block diagram of receiver 134. The signal received from the field sense coils 128 and 130 is first conditioned by bandpass filter 114. Bandpass filter 114 includes high pass filter 111 and antialiasing filter 113. In the preferred embodiment, high pass filter 111 has a 3 dB cutoff of about 5 KHz and eliminates the portion of the received signal corresponding to the drive field signal. Antialiasing filter 113 filters out high frequency signals which when sampled may cause aliasing of high frequency signals into the bandwidth of the signal of interest. In the preferred embodiment, anti-aliasing filter is implemented as an analog lowpass filter having an upper 3 dB cutoff of about 45 KHz.

The signal generated by bandpass filter 114 is sent through parallel gain stages 116 each of which is followed by an A/D converter 118. More than one gain stage 116, each producing a respective amplified signal, are provided in the preferred embodiment to ensure a non-saturated channel for normal operation of the system. In the preferred embodiment, three gain stages 116 each having a gain of approximately 74 dBV, 80 dBV and 86 dBV, are used. However, it shall be understood that a greater or lesser number of gain stages, having the same or different gain values, could be substituted therefor without departing from the scope of the present invention.

Each of the A/D converters 118 simultaneously samples its respective gain stage channel, and an additional A/D converter samples a channel corresponding to the drive field signal. The A/D converters 118 are timed by a sampling clock derived from the frequency of the power line signal. In the preferred embodiment, PLL 108 (see FIG. 1) multiplies the power line frequency by 2048 yielding a sampling frequency of 122,880 Hz for a power line frequency of 60 Hz. The receiver signals $x_i(n)$ and the drive signal d(n) are then passed to DSP 120.

Figure 3:
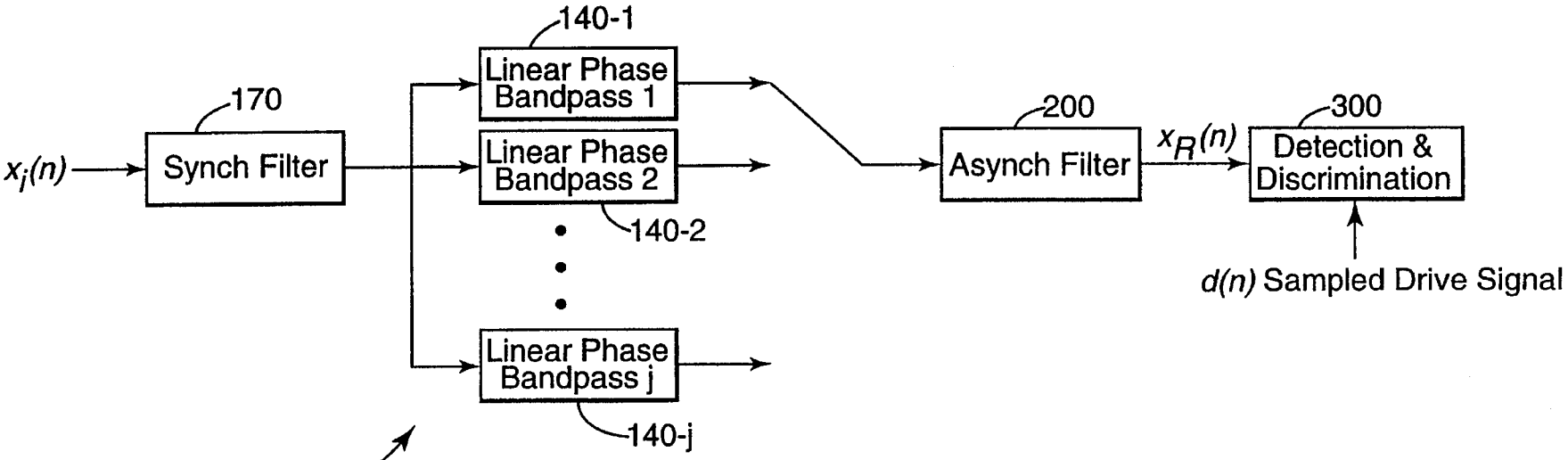
FIG. 3 shows a generalized block diagram of the functions performed by DSP 120.

FIG. 3 shows a generalized block diagram of the functions performed by DSP 120 during an interrogation. A bank of linear phase bandpass filters 140 improves the signal to noise ratio (SNR) and aids in the discrimination between sensitized tags and desensitized tags. More than one linear phase bandpass filter is provided to ensure that asynchronous interference is sufficiently reduced while maintaining as wide a passband as possible. The preferred embodiment uses a bank of three linear phase bandpass filters 140, which are preferably implemented as Finite Impulse Response (FIR) bandpass filters. When an FIR filter implementation is employed, the tap weights included within linear phase bandpass filters 140 may be determined from well known FIR filter design techniques upon specification of the desired low and high pass cutoff frequencies. Representative passbands of the linear phase filters 104 (specified by lower and upper 3 dB cutoffs) are 5 to 25 KHz, 25 to 45 KHz and 5 to 45 KHz, respectively. Which linear phase bandpass filtered signal is used for further processing is determined as described in more detail below.

Figure 7:
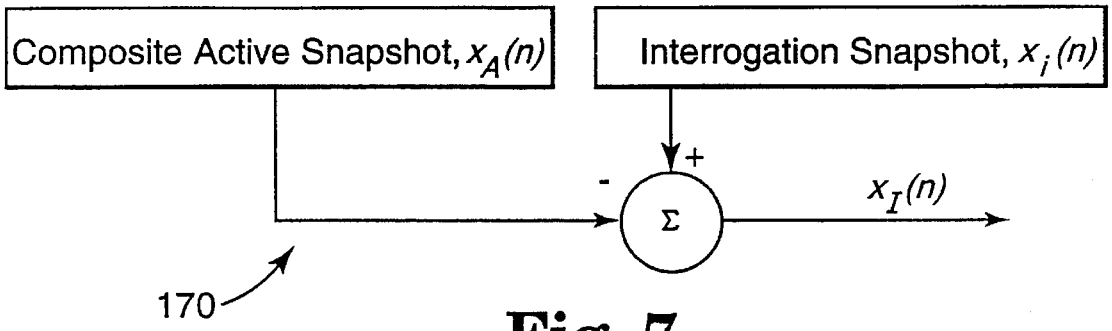
FIG. 7 shows a block diagram of the synchronous noise suppression filter of the present EAS system.

Synchronous noise suppression filter 170 (hereinafter referred to as synch filter 170) removes interrogation synchronous noise from the received signal $x_i(n)$ as described in more detail below with respect to FIG. 7, and an asynchronous noise suppression adaptive filter 200 (hereinafter referred to as asynch filter 200). Asynch filter 200 removes asynchronous correlated interference that lies within the bandwidth of the linear phase bandpass filters 140 as shown and described in more detail below with respect to FIGS. 8 and 9. To determine whether a sensitized tag is present in the interrogation zone, the residual signal $x_R(n)$ output by the asynch filter 200 is processed by a detection and discrimination block 300 as shown and described in more detail below with respect to FIGS. 10 and 11.

The general operation of the asynch filter 200 and the synch filter 170 will now be described. The asynch filter 200 removes asynchronous interference from the received signal without distorting the sensitized tag transients emitted when a sensitized tag is interrogated. The asynch filter 200 subtracts asynchronous interference from the received signal while leaving the tag signal undisturbed. The level of asynchronous interference is determined by acquiring a passive snapshot of the signal sensed by the field sense coils while the system is idle. In other words, the passive snapshot is acquired between interrogation pulses or between interrogation sequences, while the drive field signal is off. An interrogation snapshot, acquired when the drive field signal is activated to interrogate a patron, contains the background noise and will also contain sensitized tag transients if a sensitized tag is present in the corridor. By adaptively filtering the signal acquired during the passive snapshot and subtracting it from the interrogation snapshot, the asynch filter 200 removes asynchronous interference components that are correlated between the passive and the interrogation snapshots.

Similarly, the synch filter 170 removes interrogation synchronous interference from the received signal. The level of interrogation synchronous interference is determined by acquiring an active snapshot of the signal sensed by the field sense coils when the drive field signal is on. In other words, the active snapshot is an interrogation of the environment within the corridor when no sensitized tag is present in the corridor. By acquiring an active snapshot of the environment within the corridor when no sensitized tag is present, the nature of any interrogation synchronous interference can be determined. The synch filter 170 subtracts the active snapshot from the interrogation snapshot to remove the interrogation synchronous interference, without disturbing the signal of interest.

Figure 4:
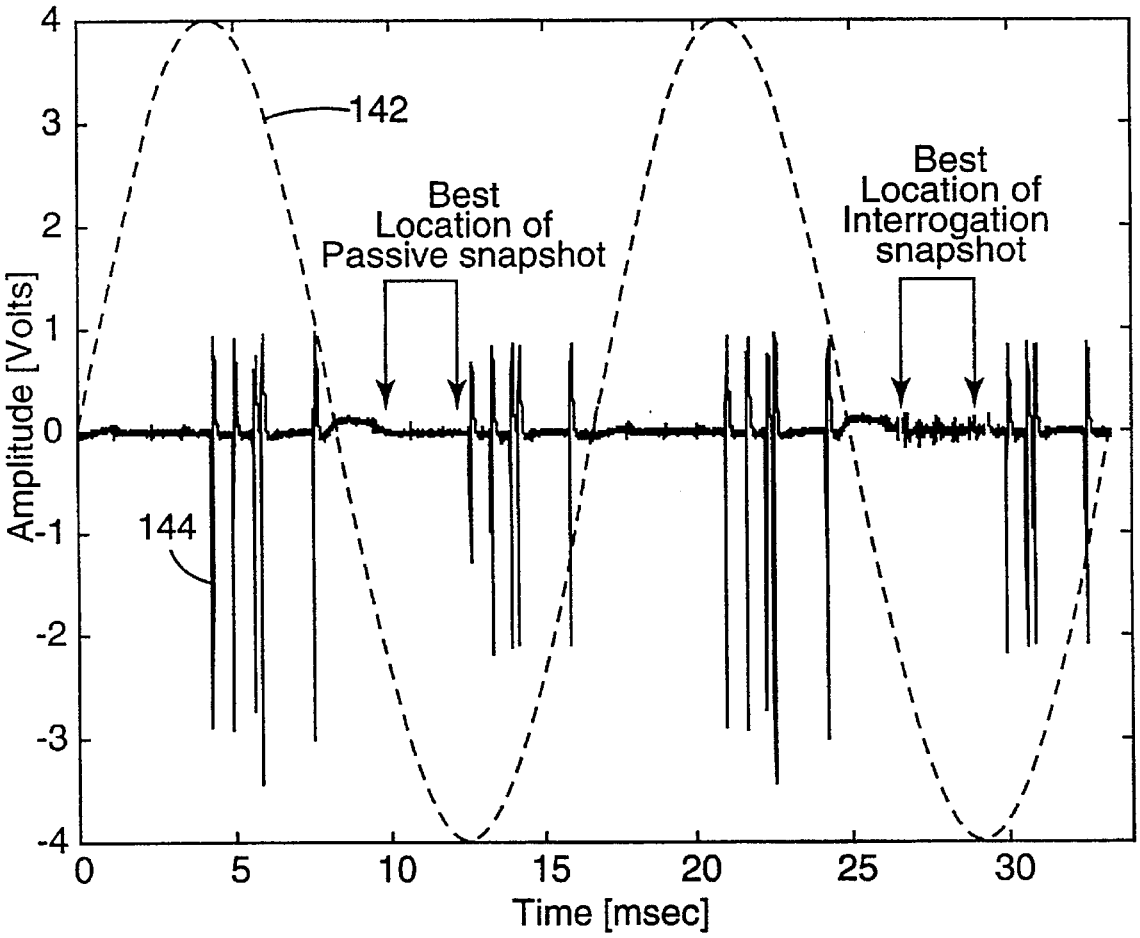
FIG. 4 shows two cycles of a power line sinusoid and an example of the corresponding synchronous noise.
Figure 6:
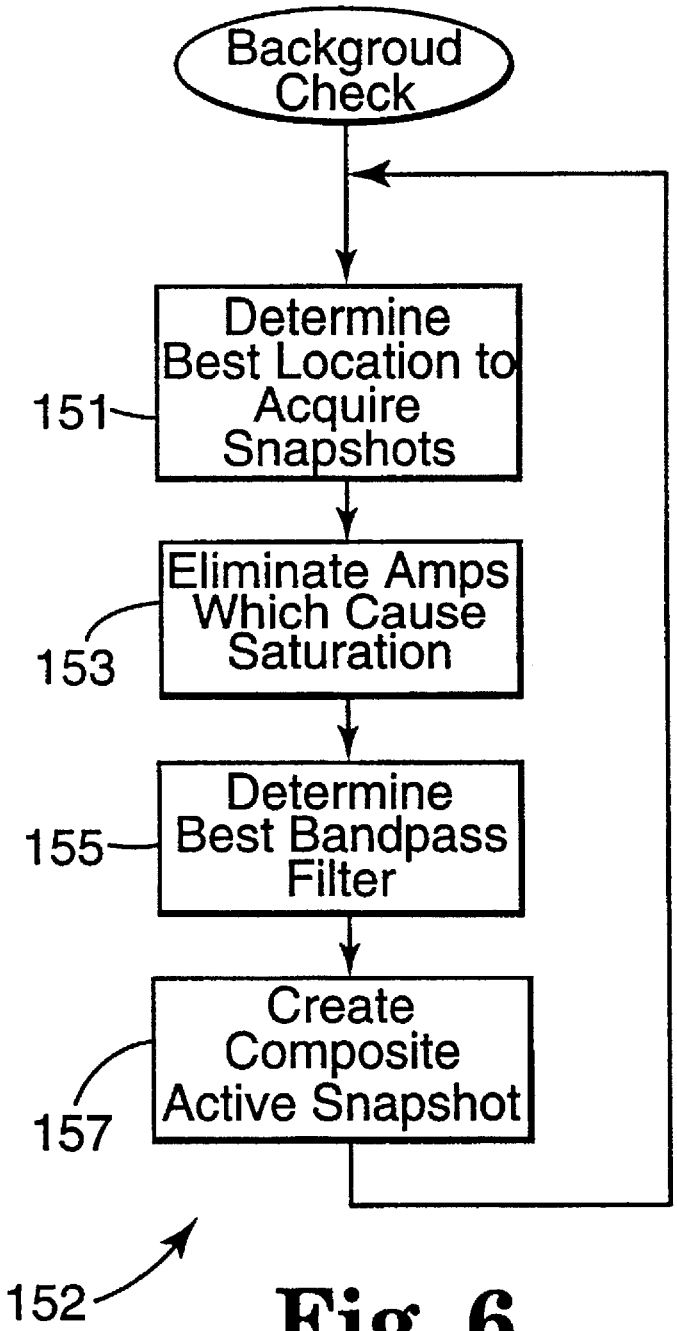
FIG. 6 shows a flow diagram for the background check process of the present EAS system.

In the preferred embodiment, the active, passive and interrogation snapshots are acquired during a time interval in the power line signal where minimum noise occurs. The time interval of minimum noise is determined as described in more detail below with respect to FIGS. 4 and 6. In this manner, interference that is synchronous with the frequency of the power line signal (power line synchronous interference) is avoided in each snapshot. Typically, power line synchronous interference is transient and appears at the same point in time relative to the power line phase. FIG. 4 shows two cycles of a 60 Hz power line sinusoid (indicated by reference numeral 142) and an example of power line synchronous interference as received by the field sense coil (indicated by reference numeral 144). To ensure that power line synchronous interference is avoided, the active, passive and interrogation snapshots are acquired during the same points with respect to the phase of the power line signal.

In the preferred embodiment, the passive snapshot is acquired one power line cycle before the interrogation snapshot. The region in the power line cycle where the snapshots are preferably acquired is indicated generally for the 60 Hz example shown in FIG. 4. It shall be understood however, that the passive snapshot could be acquired at any point before or after the interrogation snapshot. Active snapshots are also preferably acquired at a like point in the power line cycle and are preferably collected over time and combined to create a composite active snapshot. The time interval over which the active snapshots are combined and the manner in which they are combined depends upon the nature of the noise sources in the environment. In the preferred embodiment, a composite active snapshot is an ensemble average of collected active snapshots.

The timing for acquiring the snapshots is controlled by PLL 108 (see FIG. 1) which is phase locked to the frequency of the power line signal, and by DSP 120. When the photocell is blocked, the PLL 108 and the DSP 120 ensure that the interrogation sequence is timed appropriately with respect to the power line signal in the preferred embodiment.

Figure 5:
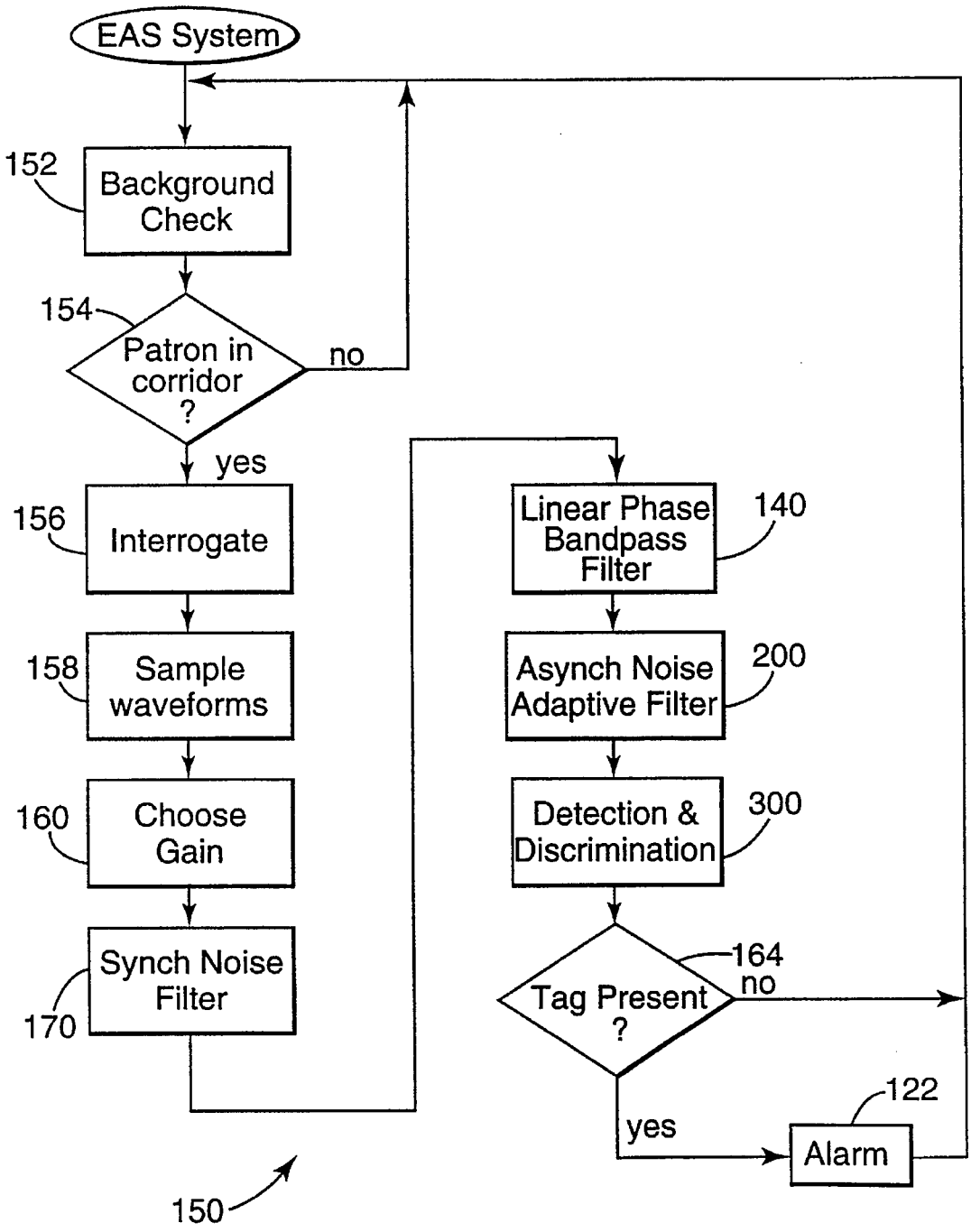
FIG. 5 shows a flow diagram of the process control for the present EAS system.

FIG. 5 shows a flow diagram of the overall operation of the present EAS system. While the system is idle, e.g., waiting for a patron to enter the corridor, the system performs a background check 152. The background check 152 is shown in more detail in FIG. 6. During the background check, the system determines several parameters which will be used during a subsequent interrogation sequence. Block 151 determines the best time interval with respect to the power line signal during which to acquire the passive and interrogation snapshots. The best time corresponds to the time in the power line signal where minimum noise occurs. The appropriate time intervals were shown graphically in FIG. 4.

To determine the appropriate part of the power line signal, the signal in the corridor is sampled over one power line cycle. Preferably, the signal in the corridor is sampled as close as possible to the actual interrogation time. Once acquired, the energy in the sampled signal is estimated in a number of intervals or subframes according to the equation $$h(k) = \sum_{i=k\cdot P}^{k\cdot P+N-1} f^2(i) \qquad \text{for } k = 0, 1 \ldots, \frac{2048-N}{P}$$

where f(n) n=0, 1, . . . 2047 are the samples of the power line signal, h(k) is the energy in each subframe, N is the length of the subframe, and P is the step size or overlap between each subframe.

The index of the minimum of h(k), given by $\hat{k}$, is used to calculate the interrogation offset for the frame. This offset is the index $\hat{k}$ multiplied by the step size P. For example, if P=8 and $\hat{k}$=113, the system will interrogate at a point 904 sample intervals after the start of a power line frame, or 7.35 msec after the start of the power line cycle in a 60 Hz system.

At block 153, the system determines which, if any, of the amplifiers 116 (see FIG. 2) would cause receiver saturation under the then current conditions in the corridor. Block 155 determines which linear phase bandpass filter 140 most reduces the energy level of asynchronous noise in the received signal. In the preferred embodiment, the energy of a signal is defined as the sum-of-squares of the signal samples. For example, for a vector of sample x of length N, the energy is defined as $$\sum_{i=0}^{N-1} x^2(i).$$

The purpose of linear phase bandpass filters 140 is to reduce the level of asynchronous interference while retaining as much of the bandwidth of the sensitized tag signal as possible. Preferably, the linear phase bandpass filter 140 having the maximum bandwidth can be used thus avoiding loss of any tag signal information.

Block 157 collects and combines active snapshots to create a composite active snapshot for use by synch filter 170.

Referring again to FIG. 5, when a photocell block indicates that a patron has entered the corridor at block 154, DSP 120 initiates an interrogation sequence at block 156. In the preferred embodiment, the timing of the interrogation sequence is synchronized to the power line signal as described above to reduce power line synchronous interference. In an alternate preferred embodiment, timing of the interrogation is not synchronized to the power line signal and is instead free running.

When the drive field signal is activated, a trigger is generated to mark the acquired data at block 158. The system preferably acquires a pre-trigger frame of data (containing the passive snapshot and a post-trigger interval of data (the interrogation snapshot. Because the passive and interrogation snapshots are synchronized to the power line phase in the preferred embodiment, the length of the pre-trigger frame and post-trigger intervals are determined in part by the frequency of the power line signal. In the preferred embodiment, the pre-trigger frame contains samples acquired over one 60 Hz power line cycle, or about 16.7 msec of data.

The length of the post-trigger interval is also affected by the frequency of the drive field signal. The frequency of the drive field signal determines the number and frequency of tag transients produced by a sensitized tag. To increase reliability and reduce the likelihood of false alarms, the post-trigger interval is preferably long enough to acquire more than one tag transient. In the preferred embodiment, about 2.5 msec of data are collected post-trigger to ensure that at least four tag transients will be acquired. It shall be understood, however, that for purposes of illustration, the post-trigger interval could be longer or shorter and should be determined in order to achieve the desired level of system performance.

The post-trigger data is the interrogation snapshot and will contain tag information if a sensitized tag is present. To ensure that power line synchronous interference is avoided, the passive snapshot is acquired one power line cycle before the interrogation snapshot. In this manner, interference that is synchronous with the power line signal is avoided in both snapshots. The passive snapshot is therefore the first 2.5 msec of the pre-trigger frame in the preferred embodiment (see FIG. 4).

After the passive and interrogation snapshots are acquired, the system determines which amplified signal produced by amplifier 116 (see FIG. 2) to use for processing in the synch filter 170 and the asynch filter 200. In block 153 of the background check, amplifiers which resulted in saturation in a noise only environment (i.e., no interrogation) were eliminated. Block 160 determines which of the remaining amplifier(s) avoid saturation during the interrogation sequence. The amplifier which results in the highest gain without saturation is chosen. This avoids possible distortion of the received signal, thus increasing the likelihood that a sensitized tag will be detected and reducing the possibility of false alarms.

The next step in the process is to condition the received signals with the synch filter 170. FIG. 7 shows a more detailed block diagram of synch filter 170. In the preferred embodiment, the synch filter 170 subtracts the composite active snapshot $x_A(n)$ from the interrogation snapshot $x_I(n)$ to produce a filtered interrogation snapshot $x_I(n)$.

Referring again to FIG. 5, the bandwidth of the signal $x_I(n)$ is further limited by the appropriate linear phase bandpass filter 140 (see FIG. 3) chosen as described above with respect to the background check.

Figure 8:
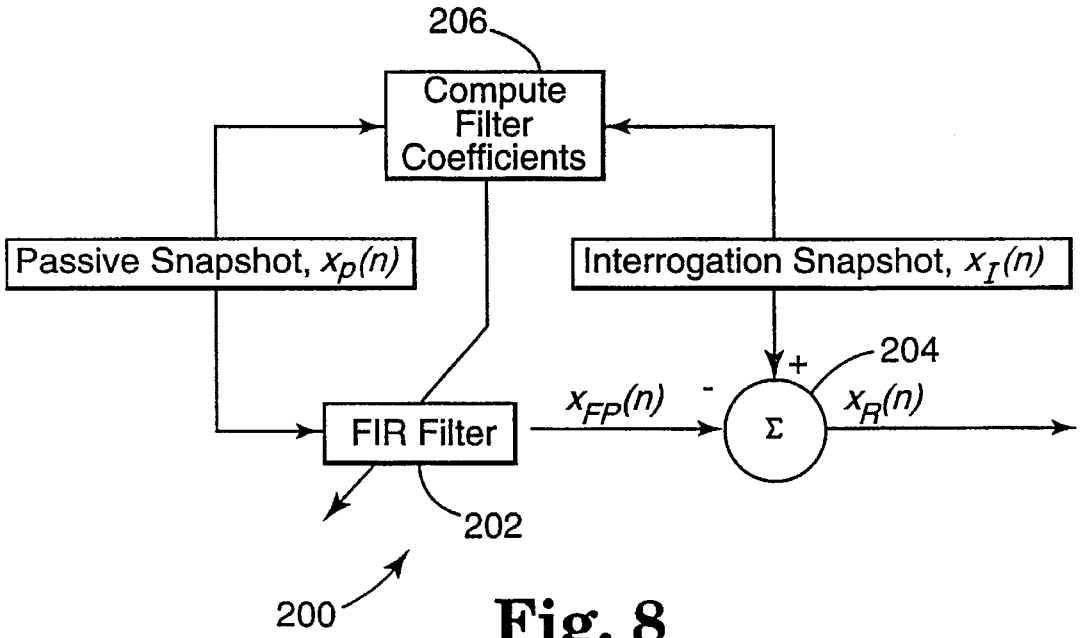
FIG. 8 shows a block diagram of the asynchronous noise suppression adaptive FIR filter of the present EAS system.

FIG. 8 shows a block diagram of the asynch filter 200. The asynch filter 200 is a block adaptive filter which conditions the passive snapshot such that the least-squares error residual between the filtered passive snapshot and the interrogation snapshot is minimized. The coefficients of the asynch filter 200 are determined adaptively after each interrogation to minimize the error residual for each interrogation snapshot. This optimization process removes correlated signals from the residual signal but retains uncorrelated ones. Thus, correlated noise is removed but the sequence of tag transients is left undistorted since it is uncorrelated with any signal in the passive snapshot. The error residual becomes the new, clean version of the interrogation snapshot, $x_R(n)$. The order of the asynch noise FIR filter 200 is determined in part by the number of noise sources in the environment. As the number of noise sources in the environment increases, the order of the FIR filter preferably increases.

Block 206 recomputes the L coefficients of the asynch filter 200 in block fashion after each interrogation such that they minimize the least squares optimization $$\sum_{n=0}^{N-1} \left( x_I(n) - \sum_{k=0}^{L-1} w(k) x_P(n-k) \right)^2$$

where $x_I(n)$ are the samples of the interrogation snapshot, $x_p(n)$ are the samples of the passive snapshot, and w(k) is the FIR filter of order L.

Subsequent to modification of the filter coefficients L, adaptive filter 200 processes the passive snapshots $x_P(n)$ in order to generate a filtered passive snapshot, $X_{FP}(n)$. In this way, the filtered passive snapshot is made available to combiner 204, which produces the desired recovered signal $x_R(n)$ by subtracting samples of the filtered passive snapshot from samples $x_I(n)$ of the interrogation snapshot according to the equation.

$$x_R(n) = x_I(n) - \sum_{k=0}^{L-1} w(k)x_P(n-k).$$

Several characteristics of the signal snapshots impact the ability of the asynch filter 200 to remove interference from the received signal. First, the noise must be present in both the passive and interrogation snapshots. Second, the sequence of tag transients used for detection must only be present in the interrogation snapshot. Third, the noise in the passive snapshot must be correlated with the noise in the interrogation snapshot, as with typical CRT noise.

Figure 9A:
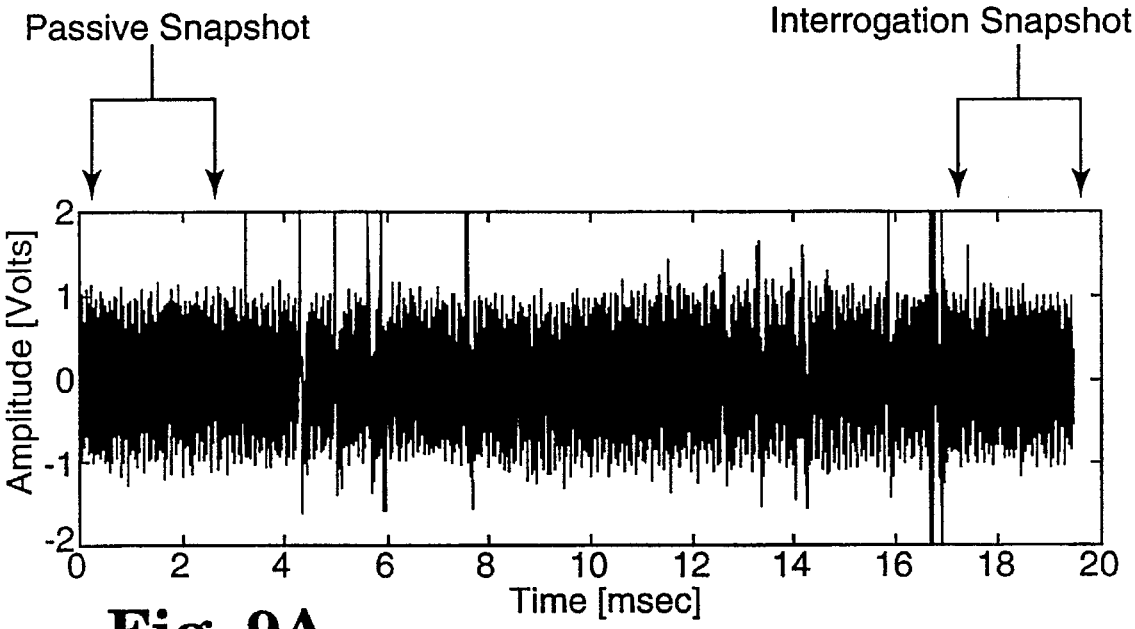
FIG. 9 shows the received signal before being conditioned by the asynch filter and the recovered signal after being conditioned by the asynch filter.
Figure 9B:
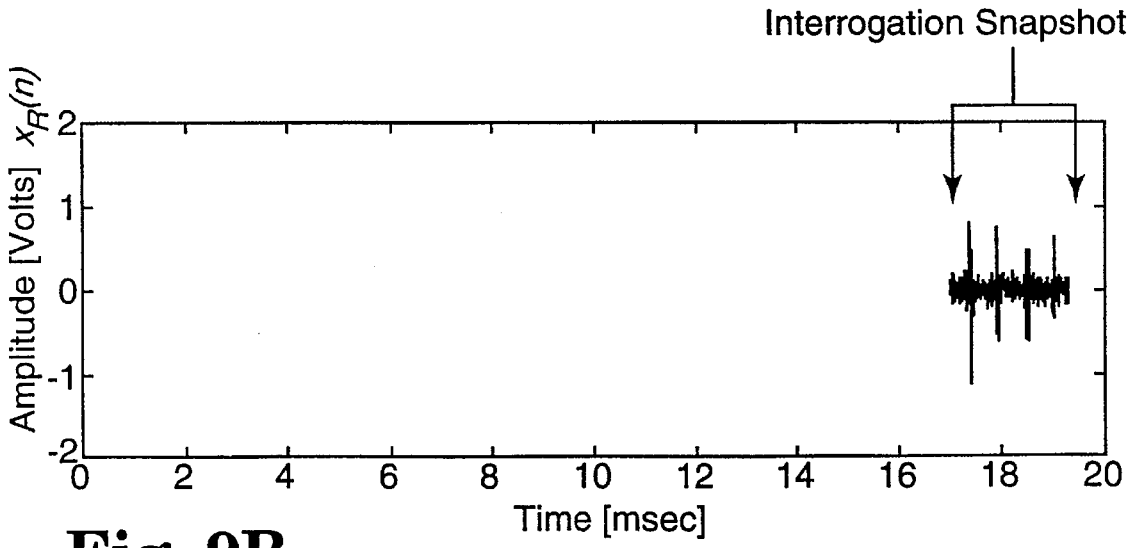

The effect of the asynch filter 200 on the resulting signal will now be explained with respect to FIG. 9. The top portion of FIG. 9 shows a pretrigger 16.7 msec frame and 2.5 msec post trigger interrogation snapshot. The signal shown in the top portion of FIG. 9 is the signal generated by the FIR bandpass filter 140 (see FIG. 3). In FIG. 9, a sensitized tag was present in the corridor when the interrogation was acquired. However, the sensitized tag signal is obscured by a substantial amount of asynchronous interference.

The asynch filter 200 removes asynchronous noise that is correlated between the passive and interrogation snapshots to produce the recovered signal $x_R(n)$, shown in the lower portion of FIG. 9. Several (in this case four) characteristic tag transients can now be seen in the recovered signal. By removing interference correlated between the passive and interrogation snapshots, the present EAS system greatly increases the likelihood that a sensitized tag will be detected, and reduces the likelihood that false alarms will occur.

Figure 10A:
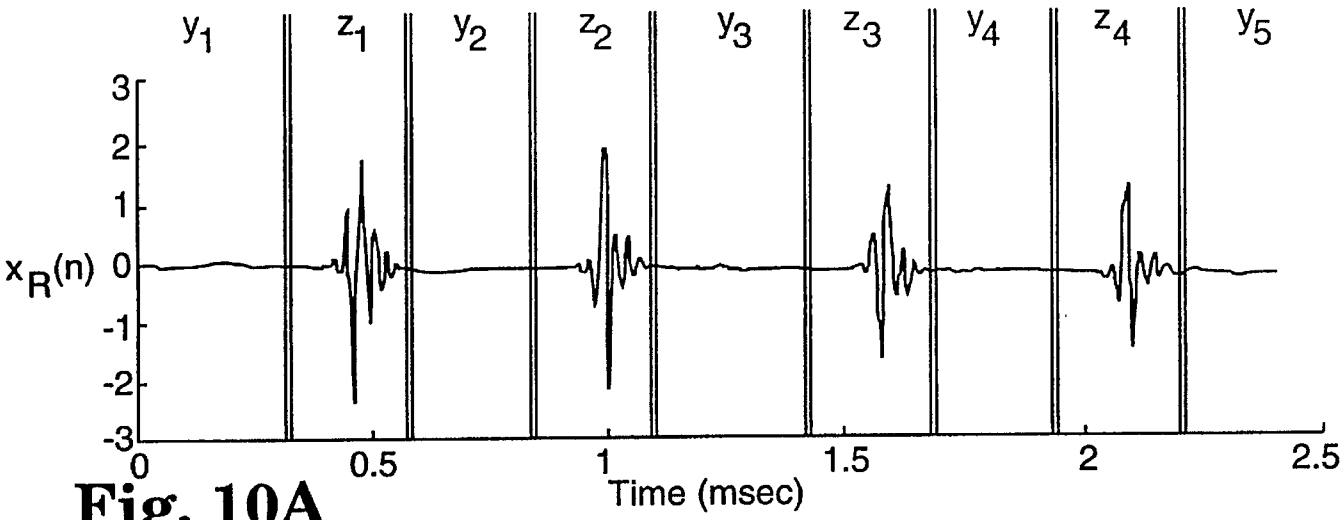
FIG. 10 shows the recovered interrogation snapshot and the corresponding portion of the drive field signal.
Figure 10B:
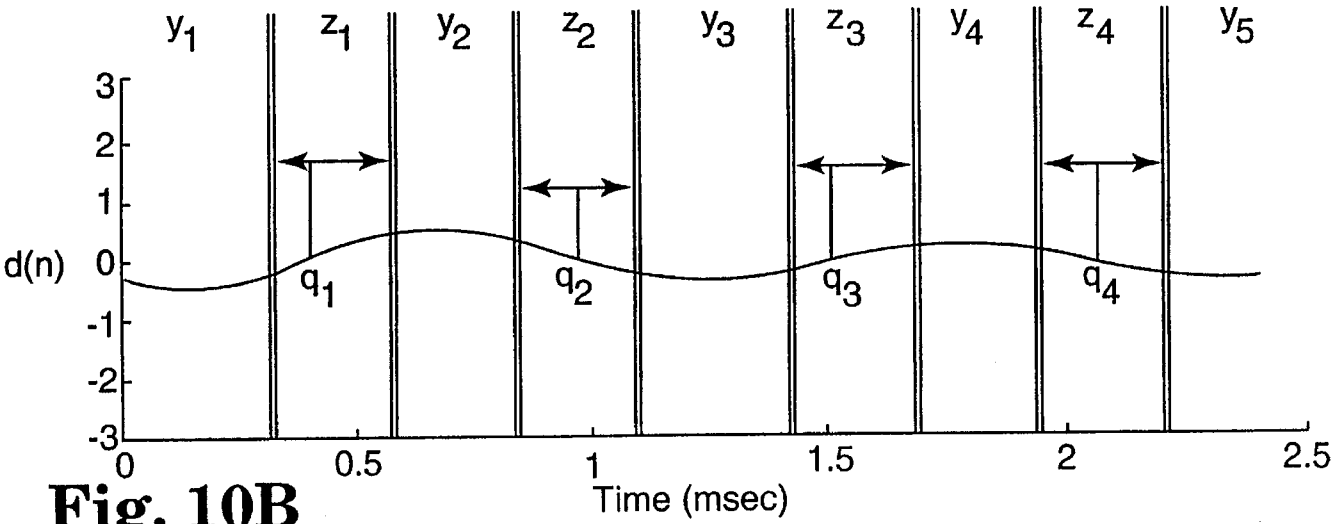

FIG. 10 shows the residual signal $x_R(n)$ generated by the asynch filter 200 and the corresponding portion of the drive field signal d(n). To determine whether a sensitized tag is present in the interrogation zone, the received signal $x_R(n)$ is analyzed to determine whether the characteristic response produced by a sensitized tag is present in the recovered signal. In general, the tag transients such as those shown in FIG. 10 will be associated with the zero-crossings $q_i$ of the drive field signal (i.e., $d(q_i)=0$). The present EAS system defines tag timing gates $z_i$ around the respective zero crossings $q_i$. The system must determine that a tag transient meeting certain criteria are present within each of the tag timing gates in order to determine that a sensitized tag is present in the corridor.

Figure 11:
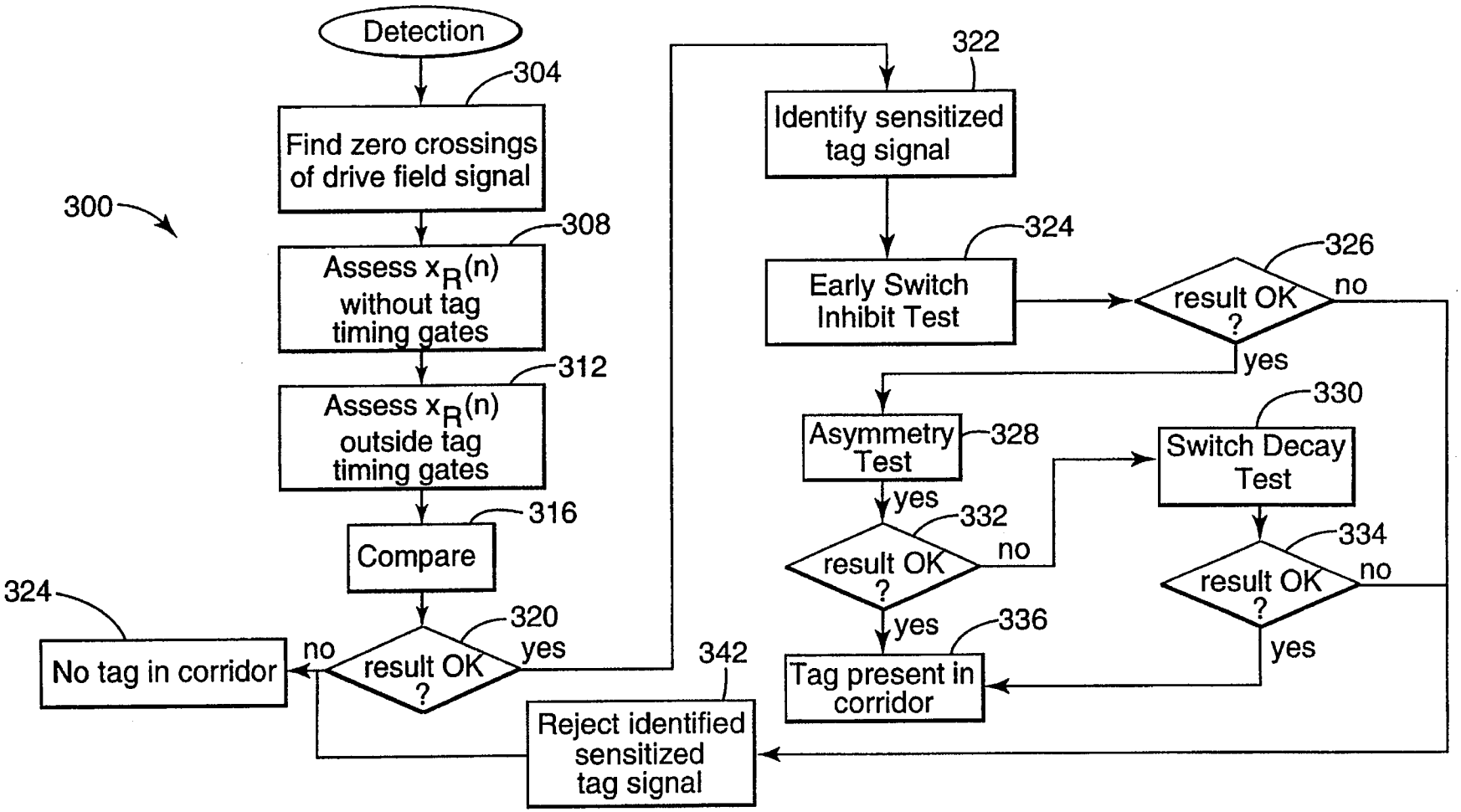
FIG. 11 shows a flow diagram of the detection process of the present EAS system.

FIG. 11 shows a flow diagram of the detection and discrimination algorithm which determines the presence or absence of a sensitized tag. At block 304, the system finds the zero crossings $q_i$ in the portion of the drive field signal d(n) corresponding to the recovered signal $x_R(n)$. At block 308, the system assesses the recovered signal $x_R(n)$ within each of the tag timing gates $z_i$, and at block 312, the system assesses the recovered signal $x_R(n)$ in the respective regions $y_i$ outside of the timing gates $z_i$. The assessments within the timing gates are compared to the assessments outside the tag timing gates. If the outcome of the comparison is favorable at block 320, the system determines at block 322 that a sensitized tag signal has been identified.

In the preferred embodiment, the system accomplishes the assessment of the recovered signal as follows. At block 308, the system finds the maximum value of $x_R(n)$ within each of the tag timing gates $z_i$. At block 312, the system finds the maximum value of $x_R(n)$ in the respective regions $y_i$ outside of the timing gates $z_i$. The maximum values within the timing gates are compared to the respective maximum values outside the tag timing gates. In the preferred embodiment, the comparison is accomplished by computing the ratio of the maximum value of $x_R(n)$ within each tag timing gate $z_i$ to the corresponding maximum value of $x_R(n)$ in the respective region $y_i$ outside each tag timing gate according to the equation $$\frac{\max(|x_R(n \in z_i)|)}{\max(|x_R(n \in y_i)|)} = \frac{S_i}{N_i} > \alpha_i$$

for each of i=1, 2, 3, and 4. In one embodiment of the present invention, if at least one of the ratios $S_i/N_i>\alpha_i$ is satisfied, the system identifies an active tag signal. However, to provide greater accuracy and minimize the occurrence of false alarms, the preferred embodiment identifies a sensitized tag signal according to the condition $B_1$ given by:

$$B_1=[(S_1/N_1>\alpha) \text{ AND } (S_3/N_3>\alpha)] \text{ OR } [(S_2/N_2>\alpha) \text{ AND } (S_4/N_4>\alpha)].$$

Figure 12A:
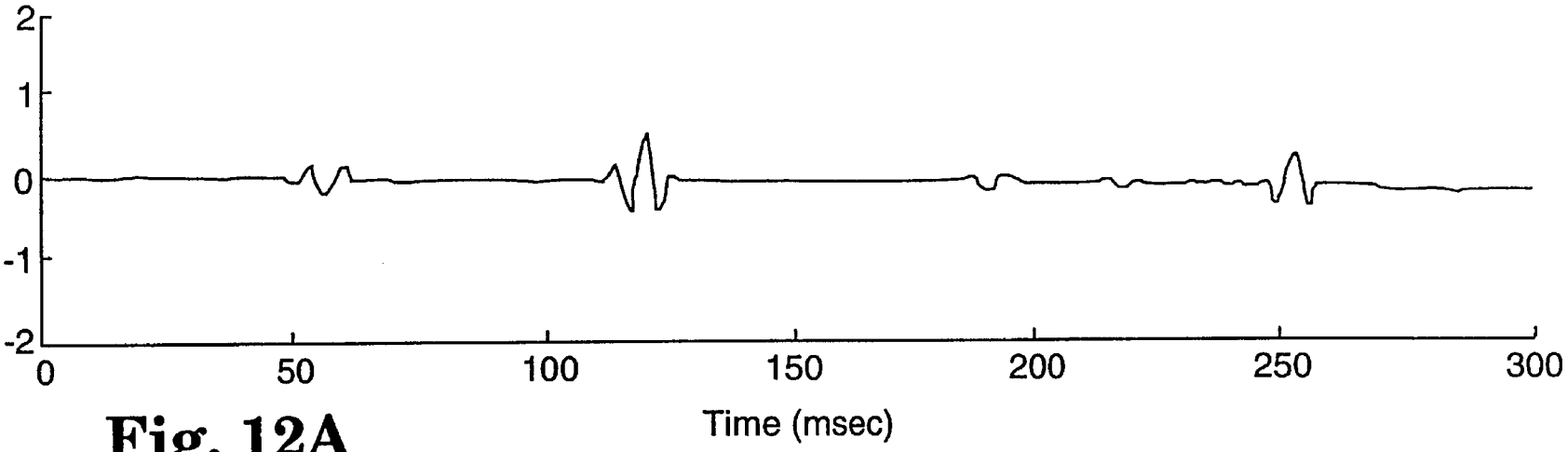
FIGS. 12A–12C show a biased sensitized switch sequence, and two switch sequences from desensitized tags, respectively.

This test measures the amplitude of the sensitized tag-induced transients or switches with respect to the amplitude of the baseline noise immediately before the sensitized tag-induced transient. If either the ratio $S_i/N_i$ of the first and third switches or the ratio $S_i/N_i$ of the second and fourth switches is above a specified threshold, then the received signal passes the test. The switches are preferably grouped in this way because the magnetic bias of the earth can affect amplitudes of the sequence of switches. If the bias is a factor, it typically affects either the first and third or the second and fourth switches. FIG. 12A shows an example of a biased switch sequence. In this case, the second and fourth switch amplitudes are much higher than the first and third.

If the condition $B_1$ is not satisfied, the system determines at block 324 that no sensitized tag was present in the corridor. If the condition $B_1$ is satisfied, the system identifies a sensitized tag signal at block 322.

In one embodiment of the present EAS system, once a sensitized tag signal has been identified at block 322, the system makes the additional determination that a sensitized tag is present in the corridor. In a more preferred embodiment, however, the present EAS system performs at least one additional check to ensure that the identified sensitized tag signal is not a false alarm. Three tests may be performed on the identified sensitized tag signal. These are an early switch inhibit test 324, an asymmetry test 328, and a switch decay test 330.

The early switch inhibit test ensures that a signal produced by a desensitized tag is not mistaken for a sensitized tag. The early switch inhibit test ensures that the following condition is satisfied.

$$B_4=[\max(N_1,N_2,N_3)/N_5<\delta].$$

Figure 12B:
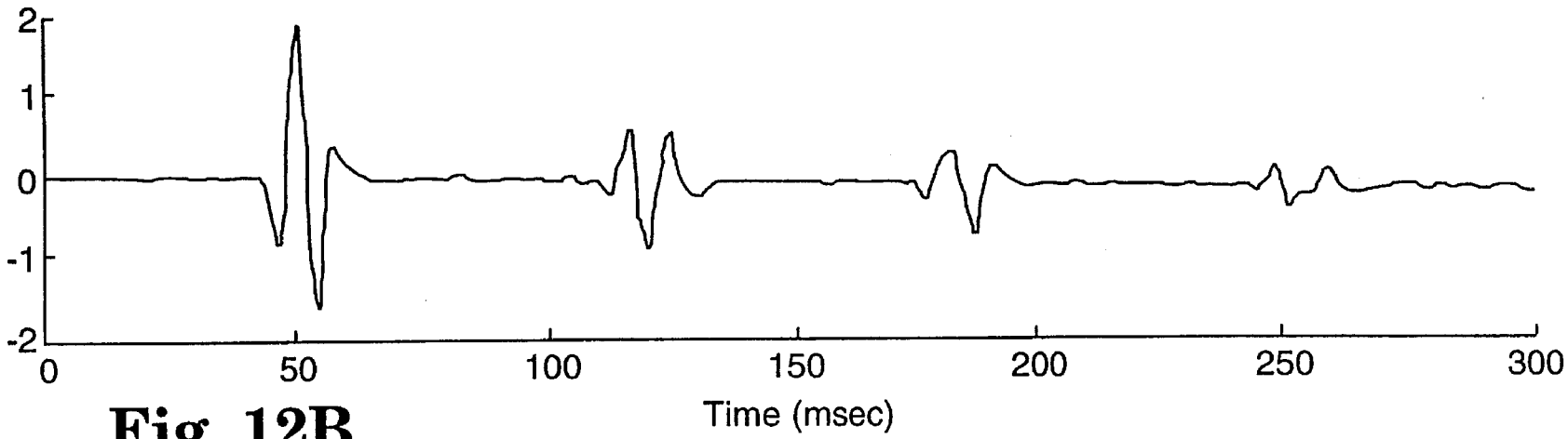
Figure 12C:
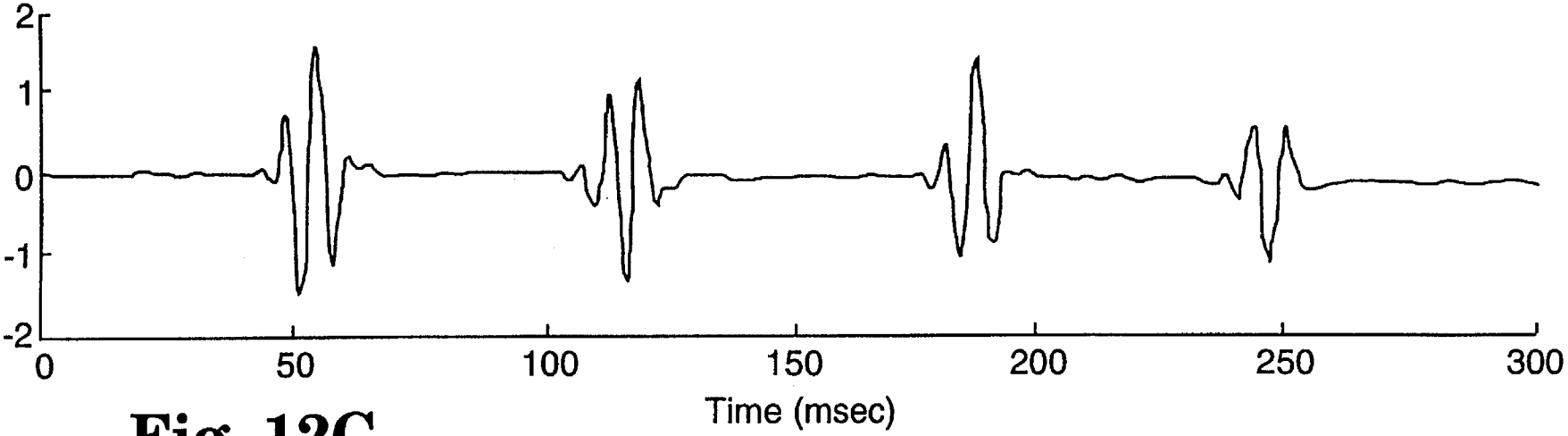

The early switch inhibit test is based on the assumption that desensitized tags and false alarm objects will tend to switch earlier than a sensitized tag. In order to measure this characteristic, the maximum values in the first three noise windows are compared to the maximum value in the fifth or baseline noise window. If this ratio is too high, then the switch sequence is too early and the signal will fail this test. FIG. 12C shows an example of a switch sequence that fails this test. In this case, the second switch is early and $N_2$ is approximately forty times the baseline value $N_5$.

The switch decay test is based on the assumption that the switch sequence decay envelope is different for sensitized tags and false alarm objects. Generally, a desensitized tag or false alarm object will have a switch envelope that decays faster than that of a sensitized tag. Again, the test is preferably calculated on alternate pairs of switches to account for bias effects. FIG. 12B shows a switch sequence from a desensitized tag. The decay envelope for this signal drops off too sharply and therefore this signal fails the switch decay test.

The switch decay test is computed as follows:

$$B_2=[\max(S_1/S_3,S_2/S_4)<\beta].$$

The asymmetry test 328 takes the bias caused by the earth's magnetic field into account. Errors which may be produced by the biasing by the earth's field are eliminated by ensuring that the following condition is satisfied:

$$B_3=[(S_2/S_1>\gamma) \text{ OR } (S_3/S_2>\gamma)].$$

The asymmetry test is based on the assumption that only the sensitized tag switch envelope is significantly affected by the magnetic bias of the earth. Typically, desensitized tags and other false alarm objects only produce a switch sequence under strong interrogation field conditions. Under these conditions, the magnetic bias of the earth has little effect on the switch sequence envelope. FIG. 12A shows a switch sequence from a sensitized tag under bias conditions. The sequence is asymmetric since the second and fourth switches are stronger than the first and third switches. The signal shown in FIG. 12A fails the switch decay test because the ratio of switch 1 to switch 3 is too large. However, it passes the asymmetry test which strongly suggests that the tag is sensitized. Thus in the preferred embodiment, if either the switch decay test or the asymmetry test is satisfied, then there is a strong likelihood that the tag is sensitized.

Exemplary values for the constants $\alpha$, $\beta$, $\gamma$, and $\delta$ are $\alpha=2.0$, $\beta=2.2$, $\gamma=1.5$, and $\delta=9.0$.

Finally, in order to determine that a sensitized tag is present in the corridor at block 336, the method shown in FIG. 11 can be expressed by the following condition:

$$\text{Detection}=B_1 \text{ AND } B_4 \text{ AND } (B_2 \text{ OR } B_3).$$

Although this condition is preferred to achieve a high likelihood that sensitized tags will be detected while minimizing the possibility of false alarms, any combination of some or all of the tests described above could be used to form a workable EAS system. The exact sequence and combination of tests utilized will depend upon the desired accuracy of detecting sensitized tags and the maximum number of false alarms which can be tolerated in a specific implementation.

Although specific embodiments have been shown and described herein for purposes of illustration of exemplary embodiments, it will be understood by those of ordinary skill that a wide variety of alternate and/or equivalent implementations designed to achieve the same purposes may be substituted for the specific embodiments shown and described without departing from the scope of the present invention. Those of ordinary skill will readily appreciate that the present invention could be implemented in a wide variety of embodiments, including various hardware and software implementations, or combinations thereof. This application is intended to cover any adaptations or variations of the preferred embodiments discussed herein. Therefore, it is intended that this invention be defined by the claims and the equivalents thereof.

We claim:

1. An electronic article surveillance system in which a drive field signal is generated in an interrogation corridor to detect presence of a sensitized tag, comprising:

means for acquiring a passive snapshot of an environment in the corridor;

means for acquiring an interrogation snapshot of the environment in the corridor; and an adaptive filter, connected to receive the passive snapshot and to receive the interrogation snapshot, and adapted to adaptively filter the passive snapshot and subtract the filtered passive snapshot from the interrogation snapshot to produce a recovered signal.

2. The electronic article surveillance system of claim 1, further including:

means for acquiring an active snapshot of the environment in the corridor; and a synch filter, connected to receive the active snapshot and to receive the interrogation snapshot, and to subtract the active snapshot from the interrogation snapshot.

3. The electronic article surveillance system of claim 2, wherein the means for acquiring an active snapshot is further adapted for acquiring a plurality of active snapshots and creating therefrom a composite active snapshot.

4. The electronic article surveillance system of claim 2, wherein the active snapshot is acquired so as to reduce power line synchronous interference in the active snapshot.

5. The electronic article surveillance system of claim 1, further including at least one linear phase bandpass filter adapted to reduce to the level of asynchronous interference in the passive snapshot and the interrogation snapshot.

6. The electronic article surveillance system of claim 1, wherein the adaptive filter conditions the passive snapshot such that the least squares error residual between the filtered passive snapshot and the interrogation snapshot is minimized.

7. The electronic article surveillance system of claim 1, wherein the passive snapshot and the interrogation snapshot are acquired so as to reduce power line synchronous interference in the passive snapshot and the interrogation snapshot.

8. The electronic article surveillance system of claim 7, wherein the passive snapshot and the interrogation snapshot are acquired at like points with respect to the phase of the power line signal, and wherein the like points are portions of the power line signal with the minimum amount of power line synchronous interference.

9. The electronic article surveillance system of claim 1, further including means for identifying a sensitized tag signal.

10. The electronic article surveillance system of claim 9, wherein the means for identifying is connected to receive the recovered signal, and further includes:

means for finding zero crossings of the drive field signal;

means for defining tag timing gates associated with the zero crossings of the drive field signal;

means for making a first assessment of the recovered signal within the tag timing gates;

means for making a second assessment of the recovered signal in an associated region outside of the tag timing gates;

means for comparing the first and second assessments to each other; and means for identifying a sensitized tag signal based on a favorable comparison.

11. The electronic article surveillance system of claim 10, wherein the means for making the first assessment further includes means for determining a maximum value of the recovered signal within each of the tag timing gates; and wherein the means for making the second assessment further includes means for determining a maximum value of the recovered signal in an associated region outside of each of the tag timing gates.

12. The electronic article surveillance system of claim 11, wherein the means for comparing further includes means for determining the ratio of the maximum value of the recovered signal inside the tag timing gates to the maximum value of the recovered signal in an associated region outside of the tag timing gates.

13. The electronic article surveillance system of claim 9, further including means for deciding that a sensitized tag is present in the corridor upon identification of the sensitized tag signal.

14. The electronic article surveillance system of claim 9, further including means for rejecting the identified sensitized tag signal based on an early switch inhibit test.

15. The electronic article surveillance system of claim 9, further including means for rejecting the identified sensitized tag signal based on an asymmetry test.

16. The electronic article surveillance system of claim 9, further including means for rejecting the identified sensitized tag signal based on a switch decay test.

17. An electronic article surveillance system, comprising:

at least one interrogation signal generator;

at least one signal sense detector;

a receiver, connected to receive a signal from the signal sense detector, the receiver further including:

synch means for filtering interrogation synchronous interference from the received signal;

asynch means for filtering asynchronous interference from the received signal and producing therefrom a recovered signal; and detection means, connected to receive the recovered signal, for identifying whether the recovered signal contains a sensitized tag signal.

18. The system of claim 17 wherein the system is a pulsed system.

19. The system of claim 18 wherein the average magnetic energy produced by the interrogation signal generator is less than 1.0 Oe.

20. A method of detecting presence of a sensitized tag in an interrogation corridor of an electronic article surveillance system, wherein a drive field signal is generated in the interrogation corridor comprising the steps of;

(a) sampling the environment in the corridor in the absence of the drive field signal to acquire a passive snapshot;

(b) sampling the environment in the corridor during presence of the drive field signal to acquire an interrogation snapshot;

(c) adaptively filtering the passive snapshot;

(d) subtracting the filtered passive snapshot from the interrogation snapshot and producing therefrom a recovered signal; and (e) assessing the recovered signal for presence of a sensitized tag.

* * * * *

UNITED STATES PATENT AND TRADEMARK OFFICE

CERTIFICATE OF CORRECTION

PATENT NO.: 5,602,531

DATED: February 11, 1997

INVENTOR(S): Michael J. Rude, Samuel H. Tao, and John E. Nelson

It is certified that error appears in the above-identified patent and that said Letters Patent is hereby corrected as shown below:

Column 3, line 41, delete "Such as" and insert therefore --Such a--.

Column 7, line 48, after the word "snapshot" insert --)--.

Column 7, line 49, after the word "snapshot" insert --)--.

Signed and Sealed this

Twenty-third Day of December, 1997

Bruce Lehman

*Attest:*

BRUCE LEHMAN

*Attesting Officer*

*Commissioner of Patents and Trademarks*